US009484007B1

(12) United States Patent
McCabe

(10) Patent No.: US 9,484,007 B1
(45) Date of Patent: Nov. 1, 2016

(54) TREMOLO STOP TUNER AND TREMOLO STABILIZER

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 0 days.

(21) Appl. No.: 14/945,035

(22) Filed: Nov. 18, 2015

(51) Int. Cl.
*G10D 3/00* (2006.01)
*G10D 3/14* (2006.01)
*G10D 3/12* (2006.01)

(52) U.S. Cl.
CPC ..... *G10D 3/146* (2013.01); *G10D 3/12* (2013.01)

(58) Field of Classification Search
CPC ..... G10D 3/146; G10D 3/12
USPC ..... 83/313; 84/313
See application file for complete search history.

(56) References Cited

U.S. PATENT DOCUMENTS

| | | | |
|---|---|---|---|
| 16,995 | A | 4/1857 | Randle |
| 644,987 | A | 3/1900 | Lyon |
| 936,624 | A | 10/1909 | Hale |
| 1,113,390 | A | 10/1914 | Wenzel-Schmidt |
| 1,253,550 | A | 1/1918 | Wilkins |
| 1,416,568 | A | 5/1922 | Mazzocco |
| 1,475,345 | A | 11/1923 | Lambert et al. |
| 1,626,753 | A | 5/1927 | Carlson et al. |
| 1,684,057 | A | 9/1928 | Fisher |
| 2,070,916 | A | 2/1937 | Peate |
| 2,130,248 | A | 9/1938 | Peate |
| 2,191,776 | A | 2/1940 | Schreiber |
| 2,254,012 | A | 8/1941 | Kudo |
| 2,262,179 | A | 11/1941 | Hammond |
| 2,453,572 | A | 11/1948 | Ferrier |
| 2,514,835 | A | 7/1950 | Bredice |
| 2,736,226 | A | 2/1956 | McBride |
| 2,741,146 | A | 4/1956 | Fender |
| 2,844,985 | A | 7/1958 | Ferriera |
| 2,873,640 | A | 2/1959 | Kunz |
| 2,973,682 | A | 3/1961 | Fender |
| 2,976,755 | A | 3/1961 | Fender |
| 3,136,198 | A | 6/1964 | Smith et al. |
| 3,313,196 | A | 4/1967 | Mari |
| 3,403,588 | A | 10/1968 | Downing |
| 3,407,696 | A | 10/1968 | Smith et al. |
| 3,437,001 | A | 4/1969 | Kraft |
| 3,575,078 | A | 4/1971 | Currier |
| 3,580,525 | A | 5/1971 | Dopner |
| 3,583,272 | A | 6/1971 | Eurich |
| 3,584,807 | A | 6/1971 | Smith |
| 3,599,524 | A | 8/1971 | Jones |
| 3,667,336 | A | 6/1972 | Itzler et al. |
| 3,678,795 | A | 7/1972 | Fullerton |
| 3,688,631 | A | 9/1972 | Jackson |
| 3,695,137 | A | 10/1972 | Eurich |
| 3,763,736 | A | 10/1973 | Williams |
| 3,780,612 | A | 12/1973 | Robinson |
| 3,911,777 | A | 10/1975 | Rendell |
| 3,911,778 | A | 10/1975 | Martin |
| 3,915,049 | A | 10/1975 | Bean |

(Continued)

*Primary Examiner* — Jianchun Qin

(57) ABSTRACT

TREMOLO STOP TUNER is integrated into the spring block portion of a traditional fulcrum tremolo, and moveable therewith about the tremolo pivot axis, comprising an adjustment device to adjust the tension of the traditional tremolo springs with the capacity to stop or block the tremolo at the equilibrium point or initial position. One embodiment includes the option to configure the novel Tremolo Stop Tuner elements as either a Global Tuner or a Stop Tuner and includes an optional setscrew for improving coupling.

5 Claims, 8 Drawing Sheets

(56) References Cited

U.S. PATENT DOCUMENTS

| | | | |
|---|---|---|---|
| 3,924,820 | A | 12/1975 | Kovar et al. |
| 4,027,570 | A | 6/1977 | Rendell et al. |
| 4,037,506 | A | 7/1977 | How |
| 4,111,093 | A | 9/1978 | Field et al. |
| 4,120,462 | A | 10/1978 | Raasch et al. |
| 4,129,154 | A | 12/1978 | Bennelli |
| 4,130,045 | A | 12/1978 | Walker |
| 4,135,426 | A | 1/1979 | Rickard |
| 4,137,812 | A | 2/1979 | Franzmann |
| 4,138,919 | A | 2/1979 | Miller |
| 4,142,435 | A | 3/1979 | Pozar |
| 4,161,903 | A | 7/1979 | Sokol |
| 4,170,161 | A | 10/1979 | Kaftan |
| 4,171,661 | A | 10/1979 | Rose |
| 4,201,108 | A | 5/1980 | Bunker |
| 4,206,679 | A | 6/1980 | Wilson |
| 4,208,941 | A | 6/1980 | Wechter |
| 4,234,133 | A | 11/1980 | Enneking |
| 4,241,637 | A | 12/1980 | Brent |
| 4,283,982 | A | 8/1981 | Armstrong |
| 4,304,163 | A | 12/1981 | Siminoff |
| 4,348,934 | A | 9/1982 | Ogata |
| 4,366,740 | A | 1/1983 | Tripp |
| 4,375,180 | A | 3/1983 | Scholz |
| 4,377,101 | A | 3/1983 | Santucci |
| 4,389,917 | A | 6/1983 | Tiebout, III |
| 4,425,831 | A | 1/1984 | Lipman |
| 4,426,907 | A | 1/1984 | Scholz |
| 4,433,603 | A | 2/1984 | Siminoff |
| 4,457,201 | A | 7/1984 | Storey |
| 4,462,295 | A | 7/1984 | Hundley |
| 4,472,994 | A | 9/1984 | Armstrong |
| 4,475,432 | A | 10/1984 | Stroh |
| 4,497,236 | A | 2/1985 | Rose |
| 4,522,101 | A | 6/1985 | Peavey et al. |
| 4,546,306 | A | 10/1985 | Alba et al. |
| 4,549,130 | A | 10/1985 | Dobberstein |
| 4,549,461 | A | 10/1985 | Rose |
| 4,555,970 | A | 12/1985 | Rose |
| 4,573,391 | A | 3/1986 | White |
| 4,608,904 | A | 9/1986 | Steinberger |
| 4,608,905 | A | 9/1986 | Takabayashi |
| 4,608,906 | A | 9/1986 | Takabayashi |
| 4,623,101 | A | 11/1986 | Cacak |
| 4,632,005 | A | 12/1986 | Steinberger |
| 4,638,708 | A | 1/1987 | Kamal |
| 4,638,711 | A | 1/1987 | Stroh |
| 4,648,304 | A | 3/1987 | Hoshino et al. |
| 4,656,915 | A | 4/1987 | Osuga |
| 4,672,877 | A | 6/1987 | Hoshino et al. |
| 4,674,389 | A | 6/1987 | Fender |
| 4,677,891 | A | 7/1987 | Gressett, Jr. et al. |
| 4,681,011 | A | 7/1987 | Hoshino |
| 4,690,027 | A | 9/1987 | Ido |
| 4,696,218 | A | 9/1987 | Hoshino et al. |
| 4,704,935 | A | 11/1987 | Franklin |
| 4,712,463 | A | 12/1987 | Kubicki et al. |
| 4,724,737 | A | 2/1988 | Fender |
| 4,760,622 | A | 8/1988 | Rohrman |
| 4,762,046 | A | 8/1988 | Aspri et al. |
| 4,768,415 | A | 9/1988 | Gressett, Jr. et al. |
| 4,779,506 | A | 10/1988 | Takeuti |
| 4,793,236 | A | 12/1988 | McGuire et al. |
| 4,803,906 | A | 2/1989 | Fender |
| 4,840,102 | A | 6/1989 | Pittman |
| 4,854,210 | A | 8/1989 | Palazzolo |
| 4,856,404 | A | 8/1989 | Hughes, Sr. |
| 4,869,145 | A | 9/1989 | Evans |
| 4,876,794 | A | 10/1989 | Myers |
| 4,882,967 | A | 11/1989 | Rose |
| 4,903,568 | A | 2/1990 | Itoh |
| 4,905,563 | A | 3/1990 | Davies |
| 4,909,126 | A | 3/1990 | Skinn et al. |
| 4,928,564 | A | 5/1990 | Borisoff et al. |
| 4,939,970 | A | 7/1990 | Hoshino et al. |
| 4,945,801 | A | 8/1990 | Stroh et al. |
| 4,955,275 | A | 9/1990 | Gunn |
| 4,967,631 | A | 11/1990 | Rose |
| 4,982,640 | A | 1/1991 | Buscarino |
| 5,012,716 | A | 5/1991 | Pagelli |
| 5,014,588 | A | 5/1991 | Omata et al. |
| 5,033,353 | A | 7/1991 | Fala et al. |
| 5,040,741 | A | 8/1991 | Brown |
| 5,052,269 | A | 10/1991 | Young, Jr. |
| 5,072,646 | A | 12/1991 | Valkama |
| 5,080,295 | A | 1/1992 | Hongo et al. |
| D324,693 | S | 3/1992 | Rose |
| 5,095,797 | A | 3/1992 | Zacaroli |
| 5,097,737 | A | 3/1992 | Uhrig |
| 5,123,326 | A | 6/1992 | Clevinger |
| 5,125,311 | A | 6/1992 | Boulanger et al. |
| 5,127,298 | A | 7/1992 | Snape et al. |
| 5,136,918 | A | 8/1992 | Riboloff |
| 5,140,884 | A | 8/1992 | Bowden |
| 5,171,927 | A | 12/1992 | Kubicki et al. |
| 5,173,565 | A | 12/1992 | Gunn |
| 5,191,159 | A | 3/1993 | Jordan |
| 5,198,601 | A | 3/1993 | McCabe |
| 5,227,571 | A | 7/1993 | Cipriani |
| 5,265,512 | A | 11/1993 | Kubicki et al. |
| 5,277,095 | A | 1/1994 | Steinberger |
| 5,277,373 | A | 1/1994 | Morton |
| 5,284,396 | A | 2/1994 | Masumura et al. |
| 5,293,804 | A | 3/1994 | Myers |
| 5,295,427 | A | 3/1994 | Johnsen et al. |
| 5,323,680 | A | 6/1994 | Miller et al. |
| 5,337,643 | A | 8/1994 | Cantrell |
| 5,343,793 | A | 9/1994 | Pattie |
| 5,347,904 | A | 9/1994 | Lawrence |
| 5,347,905 | A | 9/1994 | Cipriani |
| 5,353,672 | A | 10/1994 | Stewart |
| 5,355,759 | A | 10/1994 | Hoshino |
| 5,359,144 | A | 10/1994 | Benson |
| 5,361,667 | A | 11/1994 | Pritchard |
| 5,372,057 | A | 12/1994 | Hart |
| 5,377,926 | A | 1/1995 | Min |
| 5,390,578 | A | 2/1995 | Raymer |
| 5,390,579 | A | 2/1995 | Burgon |
| 5,398,581 | A | 3/1995 | Castillo |
| 5,410,936 | A | 5/1995 | Ellsworth et al. |
| 5,413,019 | A | 5/1995 | Blanda, Jr. |
| 5,419,227 | A | 5/1995 | Lavineway |
| 5,421,233 | A | 6/1995 | Bunker |
| 5,431,079 | A | 7/1995 | Bunker |
| 5,438,901 | A | 8/1995 | Sperzel |
| 5,452,637 | A | 9/1995 | DeCola |
| 5,458,035 | A | 10/1995 | Okamura |
| 5,460,072 | A | 10/1995 | Ferdon |
| 5,477,764 | A | 12/1995 | Carrico |
| 5,477,765 | A | 12/1995 | Dietzman |
| 5,519,165 | A | 5/1996 | Gregory |
| 5,522,299 | A | 6/1996 | Rose |
| 5,537,907 | A | 7/1996 | Rose |
| 5,539,143 | A | 7/1996 | Rose |
| 5,539,144 | A | 7/1996 | Sherman |
| 5,549,027 | A | 8/1996 | Steinberger et al. |
| 5,567,895 | A | 10/1996 | Aspri et al. |
| 5,567,903 | A | 10/1996 | Coopersmith et al. |
| 5,589,653 | A | 12/1996 | Rose |
| 5,600,078 | A | 2/1997 | Edwards |
| 5,614,688 | A | 3/1997 | Donnell |
| 5,631,432 | A | 5/1997 | Muncy |
| 5,637,818 | A | 6/1997 | Fishman et al. |
| 5,637,820 | A | 6/1997 | Wittman |
| 5,637,823 | A | 6/1997 | Dodge |
| 5,661,252 | A | 8/1997 | Krawczak |
| 5,672,835 | A | 9/1997 | Doughty |
| 5,679,910 | A | 10/1997 | Steinberger et al. |
| 5,684,256 | A | 11/1997 | Rose |
| 5,689,075 | A | 11/1997 | Rose |
| 5,696,335 | A | 12/1997 | Rose |
| 5,700,965 | A | 12/1997 | Rose |
| 5,705,760 | A | 1/1998 | Rose |
| 5,717,150 | A | 2/1998 | Rose |

(56) References Cited

U.S. PATENT DOCUMENTS

| | | | | |
|---|---|---|---|---|
| 5,734,117 | A | 3/1998 | Tanzella | |
| 5,739,444 | A | 4/1998 | Borisoff | |
| 5,756,913 | A | 5/1998 | Gilmore | |
| 5,824,925 | A | 10/1998 | Yost | |
| 5,824,929 | A | 10/1998 | Freeland et al. | |
| 5,859,378 | A | 1/1999 | Freeland et al. | |
| 5,880,383 | A | 3/1999 | Huff | |
| 5,886,270 | A | 3/1999 | Wynn | |
| 5,945,615 | A | 8/1999 | Rose | |
| 5,959,224 | A | 9/1999 | McCune | |
| 5,965,831 | A | 10/1999 | McCabe | |
| 5,986,191 | A * | 11/1999 | McCabe | G10D 3/146 84/313 |
| RE36,484 | E | 1/2000 | Turner | |
| 6,034,311 | A | 3/2000 | Fisher, IV | |
| 6,046,393 | A | 4/2000 | Rose | |
| 6,046,397 | A | 4/2000 | Rose | |
| 6,051,773 | A | 4/2000 | Rose | |
| 6,069,306 | A | 5/2000 | Isvan et al. | |
| 6,084,166 | A | 7/2000 | Lee | |
| 6,111,176 | A | 8/2000 | Rose | |
| 6,137,039 | A | 10/2000 | Rose | |
| 6,175,066 | B1 | 1/2001 | McCabe | |
| 6,194,645 | B1 | 2/2001 | Rose | |
| 6,198,030 | B1 | 3/2001 | Rose | |
| 6,283,397 | B1 | 9/2001 | Chen | |
| 6,384,311 | B1 | 5/2002 | Cota | |
| 6,420,639 | B1 | 7/2002 | Sherlock | |
| 6,437,226 | B2 | 8/2002 | Oudshoorn et al. | |
| 6,552,252 | B2 | 4/2003 | Hirayama | |
| 6,563,034 | B2 | 5/2003 | McCabe | |
| 6,686,524 | B2 | 2/2004 | Hirayama | |
| 6,723,904 | B1 | 4/2004 | Dolan et al. | |
| 6,825,406 | B2 | 11/2004 | Thidell | |
| 7,053,287 | B2 | 5/2006 | Dam | |
| 7,189,908 | B2 | 3/2007 | Lavineway | |
| 7,235,729 | B2 | 6/2007 | Minakuchi | |
| 7,297,851 | B2 | 11/2007 | Caldwell et al. | |
| 7,427,703 | B2 | 9/2008 | Geier | |
| 7,470,841 | B1 | 12/2008 | McCabe | |
| 7,479,592 | B1 | 1/2009 | Slavik | |
| 7,531,731 | B2 * | 5/2009 | Longo | G10D 3/146 84/312 R |
| 7,534,950 | B2 | 5/2009 | Lyles | |
| 7,541,528 | B2 | 6/2009 | Lyles | |
| 7,554,023 | B2 | 6/2009 | Tyler | |
| 7,579,536 | B2 | 8/2009 | Bonebrake | |
| 7,592,528 | B2 | 9/2009 | Lyles et al. | |
| 7,632,997 | B2 | 12/2009 | Small et al. | |
| 7,692,079 | B2 | 4/2010 | Lyles | |
| 7,718,873 | B1 | 5/2010 | Slavik | |
| 7,820,898 | B2 | 10/2010 | Bayliss | |
| 7,838,752 | B2 * | 11/2010 | LaMarra | G10D 3/04 84/298 |
| 7,855,330 | B2 | 12/2010 | Lyles et al. | |
| 7,888,570 | B2 | 2/2011 | Lyles et al. | |
| 8,946,529 | B2 | 2/2015 | Rose | |
| 2002/0194977 | A1 | 12/2002 | Hirayama | |
| 2003/0094087 | A1 | 5/2003 | Gregory | |
| 2003/0226441 | A1 | 12/2003 | Barney | |
| 2004/0083875 | A1 * | 5/2004 | Burton | G10D 3/146 84/401 |
| 2006/0117930 | A1 | 6/2006 | Folmar et al. | |
| 2007/0006712 | A1 | 1/2007 | Lyles | |
| 2007/0012161 | A1 | 1/2007 | Lyles | |
| 2007/0214931 | A1 | 9/2007 | Lyles | |
| 2007/0214935 | A1 | 9/2007 | Lyles | |
| 2007/0289429 | A1 | 12/2007 | Tyler | |
| 2008/0196571 | A1 | 8/2008 | Lyles | |
| 2009/0183619 | A1 | 7/2009 | Lyles et al. | |
| 2009/0301283 | A1 | 12/2009 | Lyles et al. | |
| 2012/0285312 | A1 | 11/2012 | Lyles et al. | |
| 2013/0167705 | A1 | 7/2013 | Lyles et al. | |
| 2013/0220099 | A1 | 8/2013 | Lyles et al. | |
| 2014/0020544 | A1 | 1/2014 | Lyles et al. | |

* cited by examiner

TREMOLO STOP TUNER AND TREMOLO STABILIZER

GENERAL BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9" and 16".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string through or over the bridge elements to avoid complications due to increased string diameter. The larger diameters can be problematic given the dimensions of vintage systems.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Typically, in order to facilitate the fulcrum tremolo pivoting about its fulcrum axis, counter springs, as a biasing element, are utilized to counteract or counter balance the pull of the strings. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a single body cavity comprising two distinctive sections. There is 1) an approximate 3.00"×1.00", generally rectangular, transverse the direction of the strings, traditional "tremolo pocket" or "trem pocket" extending generally perpendicular from the top surface of the body to meet at 90° providing two approximate 3.00" wide opposing faces, a first face closer the nut and a second face further the nut; and 2) the traditional, generally rectangular, approximate 4.00"×2.25"×0.775" deep, cutout extending in the direction of the strings in the back of the instrument body, a "spring pocket", to receive the spring arrangement. The spring block has a first surface closet the nut and a second surface, each surface generally perpendicular to the top of the instrument and generally parallel to the tremolo pocket first and second face. Although there are differences in specifications from one instrument manufacturer to another for the various designs of the fulcrum tremolos that are available, there is approximately 0.125" to 0.250" clearance, between the spring block and the tremolo pocket face closest to the nut, to provide for upward pitch change as the spring block pivots towards the nut. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block.

The typical spring arrangement includes, in addition to the biasing springs connected to the spring block, a "spring claw" to receive the other end of the biasing element secured by two wood screws to adjust the position of the spring claw relative to the body for a simple but cumbersome adjustment method. There is ample room for the spring block to pivot freely within the "tremolo pocket" cavity during use.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning. This is especially problematic if a string breaks with this type of tremolo; since the missing force otherwise created by the tension of the broken string allows the entire tremolo to be subject to the known "backward tilt", all the remaining strings are unmanageably sharp in pitch and the harmonic relationship to the fret placement and scale length is distorted, generally, to an undesirable degree. Furthermore, when the tremolo base plate tilts forward, the spring block tilts away from the nut; and when the tremolo base plate tilts rearward, the spring block tilts towards the nut.

This singular characteristic adds complexities in obtaining the primary goal of achieving a stable equilibrium, initial position, between the force of the tension provided by the use of two to five biasing or counter springs (connecting between the tremolo and the body) in relation to the force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

- Both the bridge portions and the string anchoring means, the tailpiece, simultaneously move about a common fulcrum axis;
- The harmonic tuning is upset and is only restored when all strings are at proper playing pitch;
- The tuning pegs or other means of tensioning the strings are inter-dependant with each other in obtaining initial position; and
- Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

- The bridge and tailpiece portions simultaneously move about the fulcrum axis when the device is pivoted for the tremolo effect;
- The fine tuner screws simultaneously move with the bridge and tailpiece portions about the tuning axis when fine tuning; and
- Fine tuners are designed to offer the tuning of the strings a minor adjustment of pitch after the general tuning is first achieved, typically, by the tuning pegs on the head of the instrument; and
- Adjusting the tension of a string by the fine tuner knob alone simultaneously adjusts the harmonic and pitch tuning and can achieve tuning a string to proper pitch conditions while simultaneously achieving proper harmonic tuning.

Improvements to the Fender '146 fulcrum tremolo have included Rose's "string clamps" at the nut, installed along with a "string tree" for some guitars, a horizontal bar positioned between the tuners and the "locking nut" arrangement, to facilitate stability and "string clamps" at a point on the opposite side of the intonation point or second critical point on each of the bridge elements relative to the nut in order to limit string stretch to the prime vibratory portion of the string within these two points defining the scale length.

Knife Edge Pivots for the Fulcrum Tremolo

Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 70/80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

DETAILED BACKGROUND OF THE INVENTION

The Stopped Tremolo

It is also known that many musicians, despite having the requisite hardware on their stringed instrument to enable a "floating tremolo" setup, intentionally choose to "block" or "stop" the fulcrum tremolo from being tilted "rearward" in order to remove the potential for an unwanted increase in pitch of the strings. This condition or setup is commonly referred to as a "blocked tremolo" or "stopped tremolo"—accordingly, the stop is considered a "hard" stop when it completely prevents pivoting the tremolo in one direction when at initial position. Additionally, as a significant part of this setup, increasing the overall tension of the biasing element past the minimum force required to make initial contact with a "hard" stop at initial position, is required to compensate for the increases in force in the tension string during bending notes, etc. meeting at least three objectives: 1) when a string breaks, the tremolo stop will ensure initial position, so that tremolo does not tip rearward and the rest of the strings do not go up in pitch, despite the missing counter balancing force of the un-tensioned or broken string, 2) ensuring the tremolo returns to initial position after radical use no matter what—to eliminate, among other things indigenous to the floating tremolo, the maintenance and care of initial position over time defined by the delicate balance of the forces and related wear and tear over time and 3) to make the tremolo less likely to be activated unintentionally compared to a floating tremolo, useful in general, for strumming, and makes double stops much more accessible when the force of the biasing element is increased. Tremolo stops of this nature have been created by small pieces of wood, plastic, etc. approximately 0.125"~0.250 or so thick which have been placed in the tremolo pocket between the spring block and the face of the tremolo pocket closest to the nut—even in "emergency" situations, a stack of guitar picks taped to the inertia block's face closest to the nut, in sufficient dimensions, can used for an evening, if need be.

Further, stopping a floating tremolo is common to meet the demands of auxiliary tension adjustment mechanisms: U.S. Pat. No. 5,359,144 ("'144") 10/94 to Robert Benson. Commercialized as the "D-tuna" mechanism for the "double-locking" Floyd Rose tremolos, the mechanism is designed to quickly re-tension the $6^{th}$ string from standard "E" down a whole step to "D" for "drop-tunings", ie., instances where the pitch of at least one string is varied compared to standard tuning—the dynamics of the forces of tension between the strings and springs require, for optimal usage, a stopped tremolo:

- A pitch changing apparatus, providing bi-stable operation within a tremolo system which produces two distinct pitches for selected strings . . .
- In the Abstract:
- The tension correcting mechanism is manually rotated to adjustable stop positions of required spring counter-tension, thereby keeping all strings in tune under conditions of changed total string tension.

Van Halen: (http://www.dtuna.com/faq.php):

- Why do the other strings go out of tune when I drop to D?

The bridge must be stabilized first. This is done by blocking the bridge so it cannot pull up. If your bridge is stabilized and the other strings are still going out of tune, you may need to increase the overall "spring tension" by moving the spring claw further from the block.

Accordingly, it is recommended by Van Halen that the "D-Tuna" device of '144 works better with an additional element or mechanism that will provide a "hard" stop the tremolo when the $6^{th}$ string is tuned to "D", the lower of the two target pitches; and, in order to ensure initial position of the fulcrum tremolo at the higher target pitch, since a hard stop requires increasing the overall force of the biasing element sufficient to compensate for the small increase in force, which unaddressed would yield a forward tilt otherwise present at the higher-tensioned "E" target pitch.

Floating Tremolo and Tremolo Stabilizers

One disadvantage, for some players, is that a "hard" stop eliminates the original capacity for light tremolo wavering effects around initial position and upward pitch bends. Accordingly, many players today would prefer a setup that acts like a fixed bridge for small force changes like bending strings, strumming at initial position yet "gives" and acts like a floating tremolo for using the tremolo arm for larger modern, pitch changes, such as "dive bombs", as is distinguished as a "soft" stop or tremolo stabilizer. As is known, the biasing element or spring system, provides a continuous generally linear force curve to establish equilibrium at initial position, but is not capable of changing its rate of tension, in general, stretching gradually and gradually as more force is applied.

Various mechanisms have been presented to assist the traditional biasing springs of Fender '146 in view of modern demands, such as the Hipshot branded "Tremsetter", Borisoff et al, U.S. Pat. No. 4,928,564 ("'564"). The Tremsetter device secured directly to the body's spring pocket, provides an adjustable pre-tensioned compression spring element added to complement the traditional biasing element to provide a discontinuous force curve exerted on the tremolo in order to provide an adjustable "soft" stop or tremolo stabilizer—the spring arrangement operable to increase the force required to pivot the fulcrum tremolo from initial position; its operability primarily to more firmly maintain the initial position of the floating tremolo compared to usage with an unassisted biasing element. Accordingly, when a force is exerted to move the tremolo out of initial position, that same tremolo is subject to a restoring force that is being borne by the stabilizing device limited enough in its range so that the compression spring element is active until the pre-tensioned restoring force is overcome during operation of the tremolo.

The Hipshot device and multi-spring variations like it, the Ibanez BackStop, the WD Tremolo Stabilizer, the ESP Arming Adjuster, the Goeldo BackBox, not all of which are available in the US at this time, none-the-less all comprise a compression spring-like arrangement deployed to complement the traditional biasing element, each secured to the tremolo spring pocket, tensioned upon installation to an approximate force of 8~10 pounds, capable of making variable contact with the spring block and urging the spring block in a direction away from the nut—these devices do not pivot with the tremolo about its axis—it requires approximately 4 pounds of force to "bend" a typical electric guitar unwound string a whole tone up in pitch under typical situations, 8 pounds or so of force will reinforce or ensure initial position under the conditions where two strings are bent.

Each such device employs a tensioned compression spring that seeks to stabilize initial position with an adjustable "soft" stop, to avoid the limitations of a 'hard" stop and to offer more stability in the instance of double stops which are otherwise more difficult:

A method of stabilizing a neutral position of a tremolo system including a pivoted bridge assembly including the steps of tensioning all of the strings of a guitar to a selected pitch slightly less than a desired pitch, tensioning certain counter-balance springs connected between said bridge assembly and the guitar body to oppose the string tension, and mechanically adjusting a certain counter-balance spring to bring the tension in the guitar strings to a desired pitch whereby said mechanical adjustment provides a mechanical stop for returning all of the guitar strings to a selected pre-tuned pitch.

Numerous other complementary mechanisms are secured to the tremolo spring pocket to enforce the position of the spring block such as Hirayama U.S. Pat. Nos. 6,552,252 and 6,686,524 for Ibanez include auxiliary springs to enforce initial position. Geier U.S. Pat. No. 7,427,703 commercialized as the "Tremol-no" releasable tremolo stop is also secured to the tremolo spring pocket in the body:

A quick-release tremolo lock device for installation into a tremolo recess, and for mounting to a movable bridge or a tremolo block of a stringed instrument such as a guitar. The tremolo lock device includes a spring mount that is adapted to be fixedly attached to at least one wall of the tremolo recess and configured to capture an end of at least one tremolo spring. A slide key is also incorporated into the device, which is connected to the spring mount about a proximate portion of the slide key. The device also includes an adjustable quick release slide receiver that is adapted to receive and to releasably capture a distal portion of the slide key to fix the position of the receiver relative to the slide key. The device further includes a tail piece joined to the quick release slide receiver and configured to be mounted in a spring hole of the tremolo block.

Lavineway U.S. Pat. No. 7,189,90 is provides a tension bar connected to the body operable on the spring block to ensure initial position:

A tension bar is held against the back of a lower portion of the tone block by at least one tension bar spring when the tone block is in a neutral position. Stopping means are provided to prevent the tension bar from urging the tone block forward of the neutral position.

The Mag-Lok from Super-Vee Tremolos, secured to the spring pocket, US patent pending, is a magnet-based alternative to the compression spring arrangement to ensure the tremolo in initial position during double stop bends and the like that is overcome when the bar is used.

Smith U.S. Pat. No. 9,029,671 provides for a device secured to the "upper surface of the body" adjustably connected to the tremolo base plate operable to selectively stop a floating tremolo:

A tremolo lock as provided preferably to allow the operator to engage the lock or stop from the topside of a guitar and tremolo base plate completing a floating double locking tremolo system preferably for electric guitars.

The Hipshot Tremsetter is also known to be installed with the D-tuna in order to improve the accuracy of the predetermined target pitches for a floating tremolo. Dam's U.S. Pat. No. 7,053,287, also secured to the body's spring pocket, for a similar device secured to the spring pocket for creating a soft stop include:

A compensator for a tremolo for a stringed musical instrument, such as an electric guitar. The compensator has an integrated tremolo stop, allowing a musician to continue playing without undue delay in the event a string breaks.

Further,

The object of the present invention is to provide a compensator having an integrated tremolo stop which allows the musician to resume playing with a minimum of delay after string breakage, and to provide ready access to the tremolo stop while keeping the number and size of the openings as small as possible.

Didan U.S. Pat. No. 6,943,284 September 2005 for a retractable tremolo stop mechanism comprising a retractable cam adjustably secured to the top body surface bracketed between the spring block and the base plate:

. . . having a first inoperative position and a second operative position in which it stabilizes the bridge plate by limiting movement of the bridge plate in one direction in response to the spring means, mean: for maintaining said cam in said first position and said second position comprising of a frictional restraint ix contact with said cam, method for establishing the normal position of the bridge, The cam is selectively operable by the player between an inoperative (retracted) position, and an operative position in which it serves to stabilize the bridge plate.

The cam is pre-set with a limit stop whereby its actuation stabilizes the bridge plate at a position providing for normal tune of the remaining strings despite the failure of any one or more strings, or for purposes of tuning the instrument.

Rose U.S. Pat. No. 8,946,529, February 2013, apparatus includes a modification of his fulcrum tremolo for top mounted Gibson-style applications to include a re-enforcing element for initial position—this design obviates the traditional spring block that pivots within the body of the instrument and the biasing element arrangement:

The apparatus includes a mounting frame configured for mounting on the surface of the body of the instrument, an attachment post secured to the body, a base plate pivotally mounted with respect to the attachment post and having a surface adapted to receive a force, a mounting assembly mounted on the base plate for holding a string of the instrument, and a first resilient member assembly for engagement with the mounting frame outside the body of the instrument and supplying a stabilizing force to the base plate against a tension force in the string. The apparatus includes a second resilient member assembly configured to be engaged with the mounting frame outside the body of the instrument and to supply a force to the base plate surface adapted to receive the force.

As discussed above all of the various compression spring based mechanisms described above are secured to the body, in the spring pocket, in particular, and, accordingly, do not rotate with the tremolo at any time, to make variable unsecured contact with the spring block to apply an expanding force supplied by compression springs against the spring block in a direction way from the nut to augment the linear force applied by the biasing element pulling in the direction towards the nut. In each case the adjustment members are very small, often positioned between the individual springs of the biasing element and difficult to adjust initially and to compensate for changes over time.

The Global Tuner invention offers a quick way to adjust the dynamic relationship between tensioning forces between the strings and springs with a thumbwheel to maintain "initial position" over time. The typical Global Tuner splits the tremolo's inertia or spring block into two sections transverse the direction of the counter springs. One section is a base element or main block that is connected to the tremolo base plate and the other section comprises a holder element connected to the biasing element or counter springs, in a format that is connected to the main block and which is, in either case, adjusted by a thumbwheel arrangement. (See Advanced Global Tuner—U.S. patent application Ser. No. 14/687,776 Apr. 28, 2015). Since acoustic coupling is best in the instance of the greatest contact between the associated parts, when the spring holder element is slideably positioned within, say, 0.031" of the base element, a first position, when the assembled parts have the greatest contact area to each other. Threading the thumbwheel to variably position the holder element in either direction will restore initial position under normal conditions while maintaining the best coupling for this design.

The Global Tuner provides a variable adjustment mechanism invention that neither meets the requirements to achieve a stopped initial position nor a "soft" stopped initial position—the need for a stable and adjustable tremolo stop tuner is clear.

SUMMARY OF THE INVENTION

Tremolo Stop Tuners and Tremolo Stabilizers

One improvement is directed towards a Tremolo Stop Tuner operable to 1) variably contact the body with the capacity to stop or block the tremolo at initial position, 2) adjustably support a compression spring element to enforce initial position or 3) global tune an independent stabilizer arrangement enforcing initial position.

A first embodiment comprising primarily an adjustment member or, alternately, a thumbwheel, threadedly connected through the spring block of a fulcrum tremolo, and moveable therewith around the tremolo pivot axis, the adjustment member extending in the direction towards the nut, by, say, 0.125~0.250", according to individual specifications, making initial contact with a tremolo pocket face in initial position, operable to form a "hard" stop preventing rotation of the tremolo spring block towards the nut; a set screw is used to secure the position of the stop and improve acoustic coupling. The adjustment member, threadely or pivotally connected to the spring block, the adjustment element can comprise a tip operable to make initial contact with the inner first face of the tremolo pocket closest the nut to stop a tremolo from pivoting in one direction when at initial position. A setscrew can be added as referenced above.

In another alternative embodiment, a holder element separate from the spring block base element includes the adjustment member or a thumbwheel element. Either the extended portion or the tip is adjusted towards the tremolo pocket face and away from the base element to make initial contact. A set screw, threadedly positioned in the base element and in variable contact with the thumbwheel adjustment mechanism, is threaded in a first direction to fix the position of the extended portion at initial contact to form a stop to impede rotational movement in one direction from initial position. Re-adjusting the biasing element with the traditional adjustment screws in spring claw arrangement, as discussed above, is required to increase the tension to further exploit the advantages of a "hard" stop setup.

Another over all improvement is directed to compression spring based stabilizers, secured to the spring block and various arrangement, operable to make initial contact with a surface in the tremolo pocket with a limited pre-determined force operable to ensure a "soft" stop at initial position, supplementary adjustment features are further disclosed. The compression spring element complements the biasing element to comprise a limited discontinuous force operable to increase the force required to pivot the fulcrum tremolo from initial position. The "soft" stop or tremolo stabilizer arrangement comprising, for example, compression spring arrangements including the use of spring plates in various shapes, sizes, etc., secured to the main block, and moveable therewith, to complement the force of the biasing element at initial position Accordingly, when a force is first exerted to move the tremolo out of initial position, that same tremolo is immediately subject to a restoring force that is being borne by the stabilizing device limited enough in its range so that the compression spring element is active until the pre-tensioned restoring force is overcome during operation of the tremolo.

In one embodiment, the compression spring element is pre-determined compressed in a form comprising at least one L-shaped spring steel-like plate, extending generally towards the nut, with a short leg connected to the spring block and/or the base plate and a longer leg extending downwardly towards the biasing element within the first face of the tremolo pocket, bent sufficiently to comprise a pre-determined force expanding against one of the faces within the tremolo pocket at initial position, that in combination with the biasing element creates a discontinuous force sufficiently focused on a small rotational field to reinforce initial position and mild enough to allow the player to utilize the tremolos' intended capacities more fully. Given that the tension of the L-shaped plate is fixed or per-determined by its shape and thickness of material and the distance to the front face from the tremolo block is somewhat varied, and that the final outcome of active pre-tension at initial position is further altered by variables such as the gage of strings, the number of springs used in the biasing element, etc., a set-screw extending through the main block to make variable contact with the L-shaped spring will variably affect the active length of the longer leg to offer adjustment of the operable force. Further, adjusting the spring claw screws for adjusting the force of the biasing element in the spring pocket will inter-cooperate with the force of L-shaped spring steel-like plate applied to the face of the tremolo pocket to reinforce initial position for strumming and light tremolo action.

A more adjustable embodiment of the tremolo stabilizer comprises a pre-determined pre-tensioned compression spring clip-like element secured to the extended portion operable to make initial contact with the tremolo pocket face at initial position. This arrangement reassigns the thumbwheel adjustment member of the Tremolo Stop Tuner to instead variably position the clip-like compression spring arrangement relative to the inner face of the tremolo pocket to alter the force of the pre-tension. The setscrew arrangement fixes the position of the thumbwheel and couple the device to the instrument. Alternately, say, a removable 2 mm thick foam rubber strip, or such with sufficient elasticity could be positioned on the extended portion operable to comprise a force sufficient to reinforce initial position for stabilized strumming, etc.

The Adjustable Stop Tuner holder element further comprising a secondary spring holder along with the set screw and thumbwheel improvement can alternatively comprise an advanced Global Tuner—to switch setups 1) release the fixed position of the "hard" stop by loosening the setscrew to 2) allow free rotational movement of the thumbwheel in order to 3) threadedly withdraw the stop and, thereby, the holder element, to a position free from limiting the rotation of the tremolo 4) re-adjust the traditional spring claw arrangement to reduce the force applied by the biasing element to convert the biasing element position arranged for the stop into a position suitable for a Global Tuner, 5) thread the thumbwheel, and as needed over time, and 6) maintain setscrew to fix and couple the apparatus to finish the setup. As is known, a "soft" stop/tremolo stabilizer is incompatible with a "hard" stop setup. It is important to understand the two applications are mutually exclusive to each other such that neither feature can be deployed at the same time, nor changed "on-the-fly", due to these opposing setup requirements.

In a preferred embodiment, for a fully adjustable soft stop, an independently adjustable pre-determined or pre-tensioned internal compression spring arrangement comprising a Tremolo Stabilizer is presented. The Tremolo Stabilizer comprising a housing threadedly secured to the spring holder extended portion or alternatively to the main block. The most preferred arrangement having a housing, a washer and coil or wave spring at one end, a support collar or guide element variably positioned within tensioner element and the formed openings in the extended portion, an adjustment pin threadely connected to the collar operable to variably extend the adjustment pin to the tremolo pocket. The adjustment pin comprises a rounded tip often and sometimes comprises a ball bearing element. The device includes the compression of the internal compression spring within the housing of the Tremolo Stabilizer to comprise a pre-determined force of approximately 4 pounds determined at the factory at the time of assembly. A player can adjust the pre-tensioned condition of the compression spring by rotating the housing. Accordingly, the apparatus comprises a limited discontinuous force operable to increase the force required to pivot the fulcrum tremolo from initial position. Since the adjustment by the tensioner element of the force of the internal compression spring is independent of the adjustment of the forces of the biasing element, the thumbwheel is free to be operable to re-establish initial position on the fly without altering the integrity of the finely adjusted pre-tensioned forces of the spring arrangement.

"Initial position" refers to the position of the fulcrum tremolo and, therefore, the position of the second critical point on the bridge elements in relation to the first critical point on the nut such that the tension of the strings, each at the intended proper pitched condition, the spring block, and the appropriately tensioned counter springs, renders a specific equilibrium point wherein the harmonic tuning for all the strings is simultaneously achieved.

"Global Tuner" refers to an adjustment device added to a fulcrum tremolo and its associated counter spring or biasing element arrangement with the capacity to essentially re-establish the equilibrium point, created at the time of the initial setup by the tension of the counter spring(s) and the tension of the strings, in order to compensate for changes in tension requirements on the strings and/or the counter springs due to various factors. The Global Tuner preferably employs an adjustment knob or thumbwheel element for providing continuously variable adjustment of the tension in the strings by varying the relative distance between the spring attachment portion connected to the fulcrum tremolo and the attachment point of the springs to the body of the instrument. The Global Tuner thumbwheel portion provides a simple and quick means for the musician to adjust the initial position of the fulcrum tremolo in order to meet the pitch requirements in varied environmental or other situations and, in re-establishing the initial position, allows the full range of pivoting the fulcrum tremolo.

"Initial contact" refers to instance of an adjustment when a tuning mechanism first touches the instrument body, the tuning mechanism operable to affect initial position in a fulcrum tremolo.

A "hard" stop provides initial contact operable to impede rotation of the fulcrum tremolo in one direction at initial position; the "over-tightening" of the biasing element requirement to reinforce initial position obviates a global tuner.

"Tremolo Stop Tuner" refers to device integrated into a fulcrum tremolo spring block, moveable therewith about the tremolo pivot axis, comprising a holder element comprising an extended portion operable to either variably contact the body with the capacity to stop or block the tremolo at initial position, adjustably support a compression spring element to enforce initial position or global tune an independent stabilizer arrangement enforcing initial position.

A "soft" stop provides initial contact operable to affect a limited discontinuous force curve exerted on the tremolo spring block to adjustably impede rotation of the fulcrum tremolo in one direction at initial position. The adjustability obviates a stop mechanism.

"Initial condition" refers to the instance of an adjustment of the force operable at initial contact to complement the force of the biasing element when at initial position for a "soft" stop.

A "Tremolo Stabilizer" refers to an compression spring element based arrangement added to the fulcrum tremolo spring block, moveable therewith about the tremolo pivot axis, to make initial contact with the body operable to urge the spring block in the direction away from the nut with sufficient force to complement the essentially linear performance of the biasing element to create a discontinuous force curve to enforce initial position. Accordingly, when a force is exerted to move the tremolo out of initial position, the tremolo is subject to a restoring force that is borne and defined by the pre-tension stored in the compression spring element until the restoring force is overcome or disengaged during deeper rotation or pivoting of the tremolo.

Given sufficient focus of the discontinuous force at initial position to impede rearward tilt, the soft stop arrangement can be combined with an auxiliary quick pitch change apparatus, like the D-tuna, the Drop Tuner—McCabe U.S. patent application Ser. No. 14/880,271 ("'271") or any device with the capacity to quickly change from one adjustable predetermined pitch to another adjustable predetermined pitch and back to ensure the tremolo remains at initial position when the higher tensioned string is toggled to a lower tensioned condition.

Also shown is a locking macro-tuner mechanism comprising an articulated extended tip of extended laver-clamp improvement to facilitate threading a string through the nose slot to pivot or lift the clamp lever for successful loading of the string from a direction opposite or distinct from the traditional direction of operation carried out from the direction the tailpiece portion securing the string to the instrument.

Figure 3:
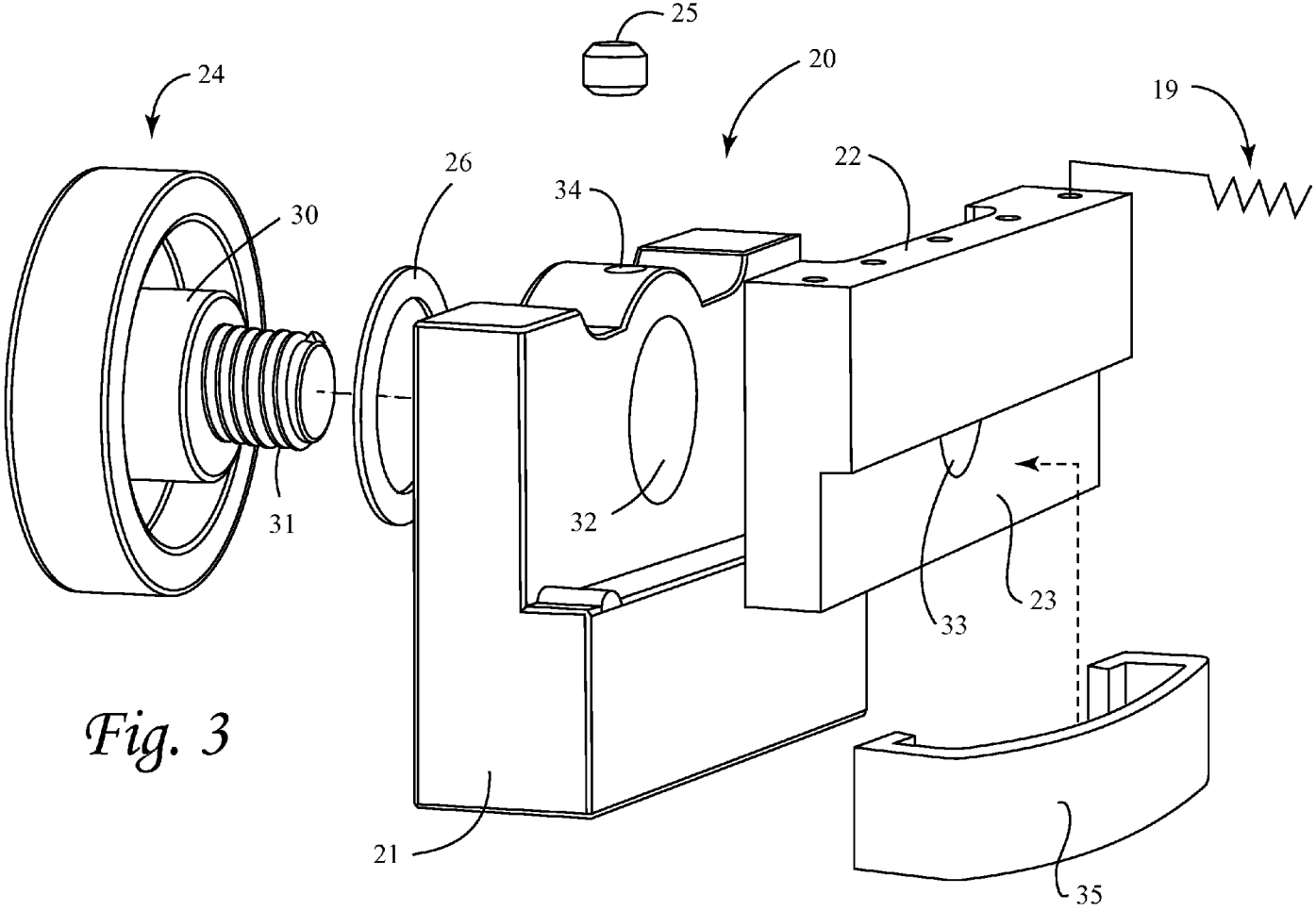

FIG. 3 is an exploded view of a first Tremolo Stabilizer embodiment configured by repurposing parts of and adding components to the Stop Tuner. A pre-tensioned compression spring-like element, supportedly positioned by the extended portion of the holder element in and between the base element and the tremolo pocket first face, is operable to exert a variable limited force at initial contact to enforce initial position. The compression spring-like element complements the biasing element to create a variable "soft" stop or Tremolo Stabilizer. Threading the adjustment element or thumbwheel in this setup is operable to variably adjust the rate of the force of the pre-tension in the context of the configuration's interdependence with force of the biasing element at initial position.

Figure 2:
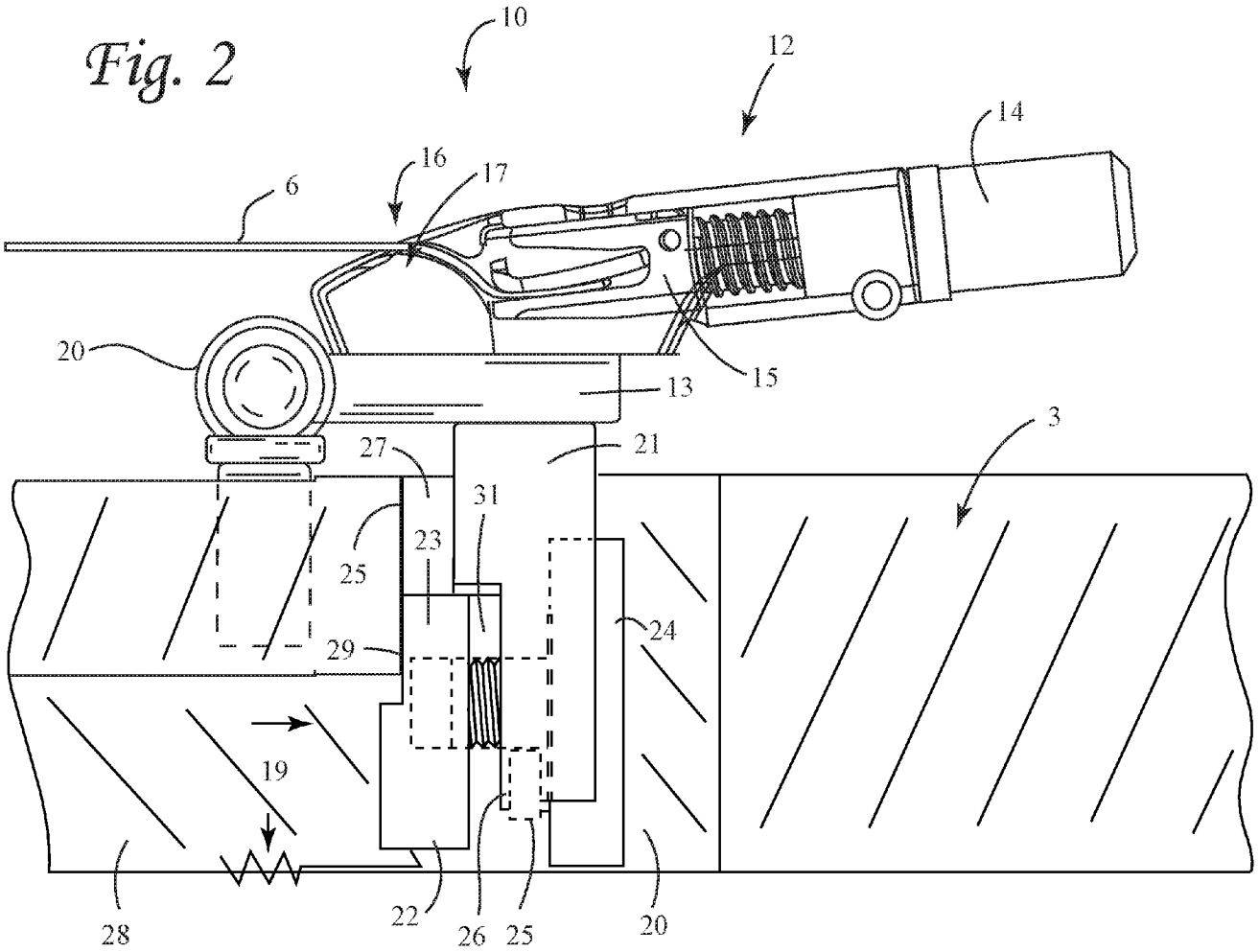
FIG. 2 is a side view of the tremolo mechanism showing the Stop Tuner in profile. A spring holder element is in a novel position, about 0.125" to 0.250", relative to the main inertia block further comprising an extended portion having a generally planar surface, approximately 90° to the direction of the strings, operable to makes initial contact with a generally planar parallel surface or first face, closest the nut, formed by the tremolo pocket. In this depiction, the extended portion functioning as a stop element is shown making initial contact blocking the rotation of the tremolo in one direction from initial position. A set screw or adjustment member is shown threadedly connected to the base element to make variable contact with the thumbwheel shaft; tightening the adjustment member fixes the position of the extended portion against the instrument body to "stop" the tremolo. Tightening the adjustment member improves coupling among the associated parts.
Figure 4:
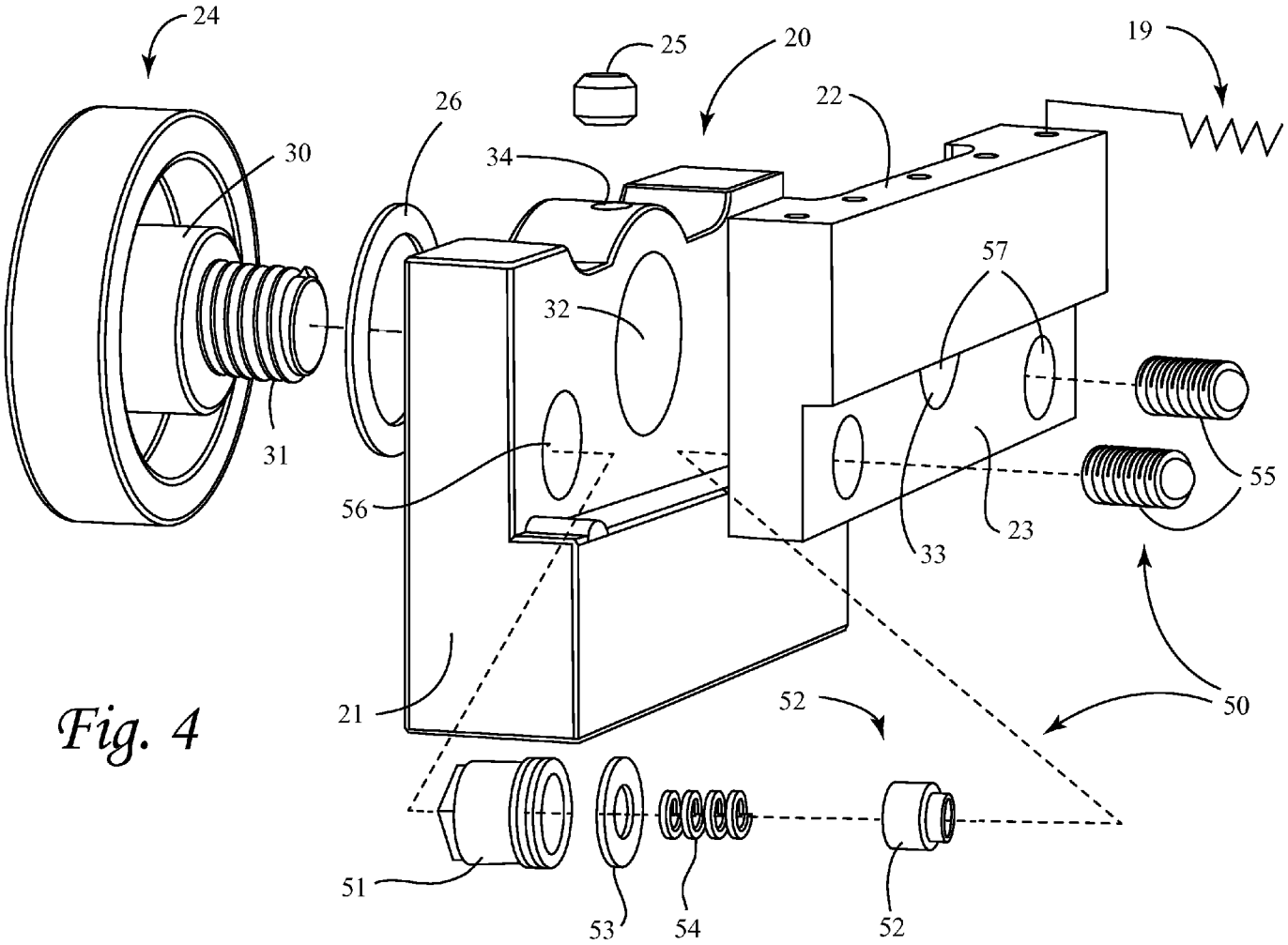

FIG. 4 shows a fully independent adjustable Tremolo Stabilizer, repurposing the stop aspect of the extended portion as seen in FIG. 2 to variably support and position a tensioner element including a guide element, a fine adjustment element, a pre-tensioned compression spring and washer; the tensioner element is threadedly connected to the extended portion, positioned additionally within cooperating cavities in the main spring block. The tensioner element formed to receive the washer, the compression spring and guide element, compression spring positioned between the guide element and the washer, threading the tensioner element adjusts the pre-tension of approximately 4 pounds, twin mechanisms (not shown) are used, one on each side of the center mounted thumbwheel adjustment element operable with sufficient force to variably enforce initial position. The fine adjustment element is theadedly secured within the guide element and operable to adjust the tip in dimensions up to more than 0.250 from the spring block to the first face for initial contact. Since threading the tensioner element is independently operable to variably adjust the rate of the force of the pre-tension, this configuration benefits from the increased stability and improved acoustic coupling set screw improvement and frees the thumbwheel element to global tune the stabilized initial position over time.

Figure 5:
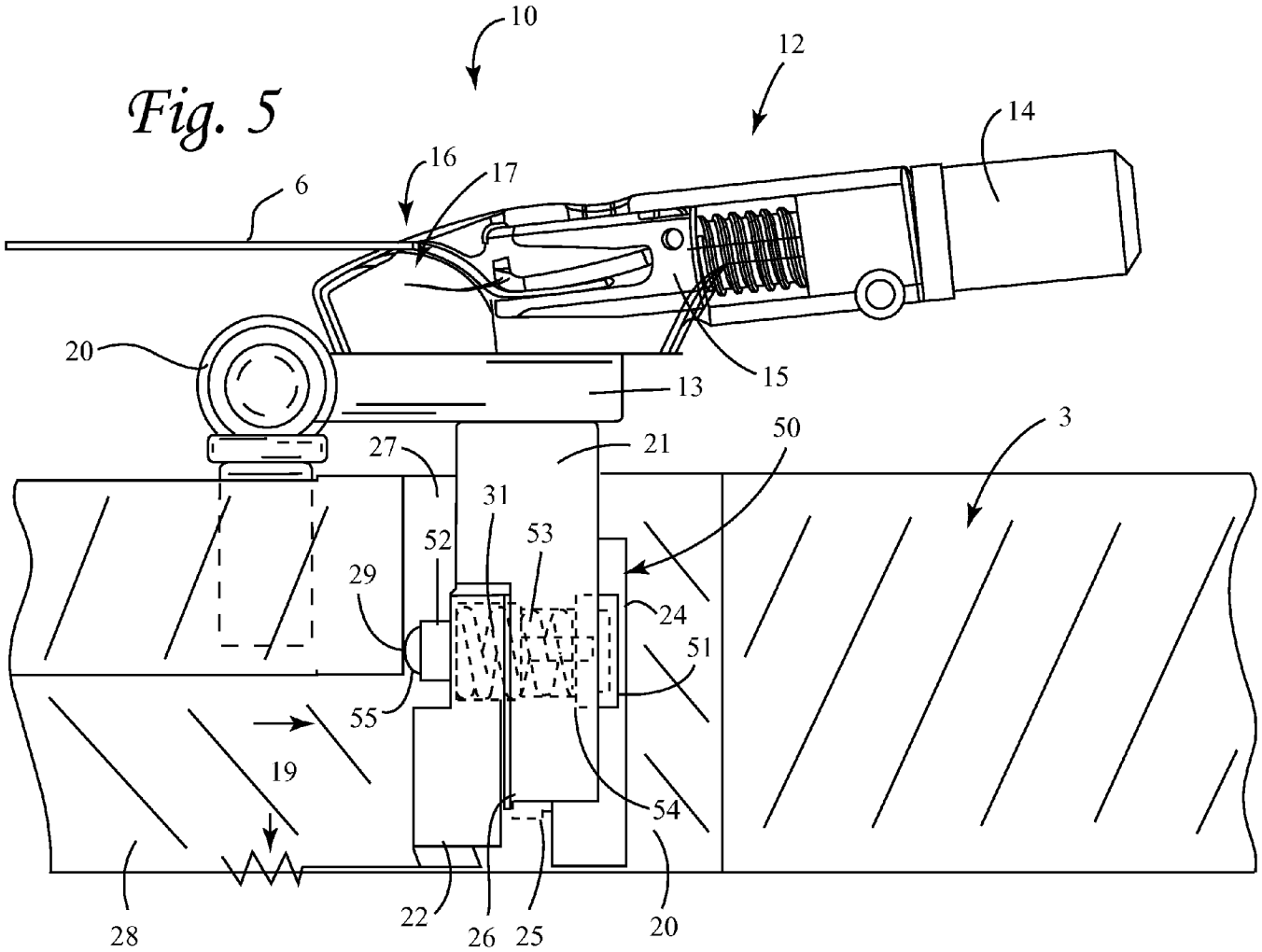
Figure 6:
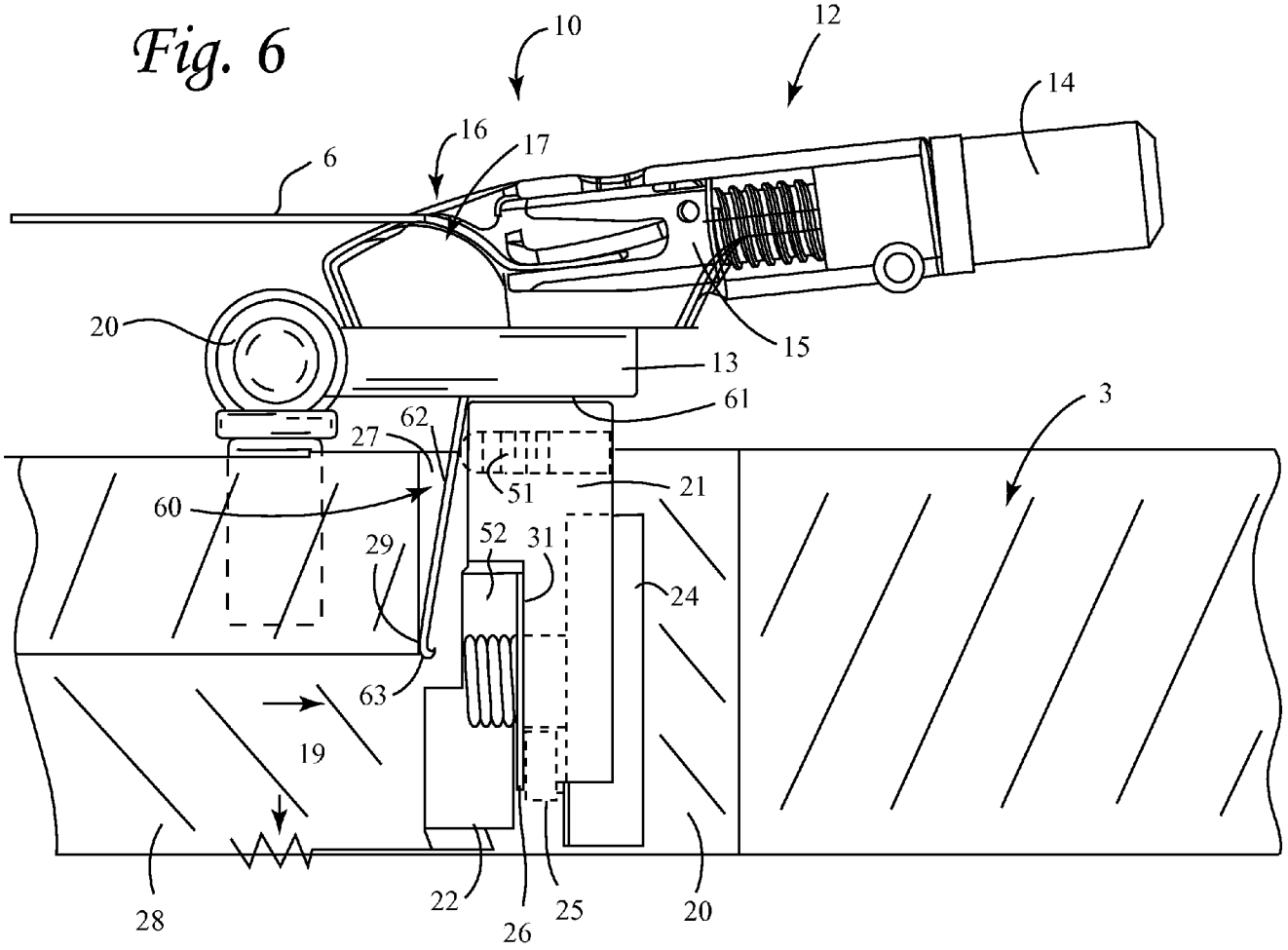

FIGS. 5 and 6 show two alternative Tremolo Stabilizer embodiments in profile where the thumbwheel function is also independent of the adjustment of the stabilizer. FIG. 5 shows a profile view of the Tremolo Stabilizer improvement shown in FIG. 4 including its relative position in the tremolo pocket area at initial contact. FIG. 5 shows a single adjustable stabilizer mechanism capable of exerting a combined force of at least 8 to 10 pounds to variably ensure initial position.

FIG. 6 shows an adjustable stop tuner configured for a setup with a global tuner wherein a further alternative example of a Tremolo Stabilizer comprises a single pre-tensioned L-shaped bent piece of sheet metal positioned between the tremolo base plate, and moveable therewith, with the short leg between the spring block element and the base plate and the longer leg extending with a mild curve at the tip for initial contact with the tremolo pocket as shown in FIG. 3. Pivoting the tremolo to flatten pitches engages the pre-tensioned L-shaped spring steel stabilizer mechanism to reinforce the initial position. A setscrew operable to variably contact the L-shaped long leg to modify the rate of the spring is presented. Further, the biasing element can be adjusted.

Figure 7:
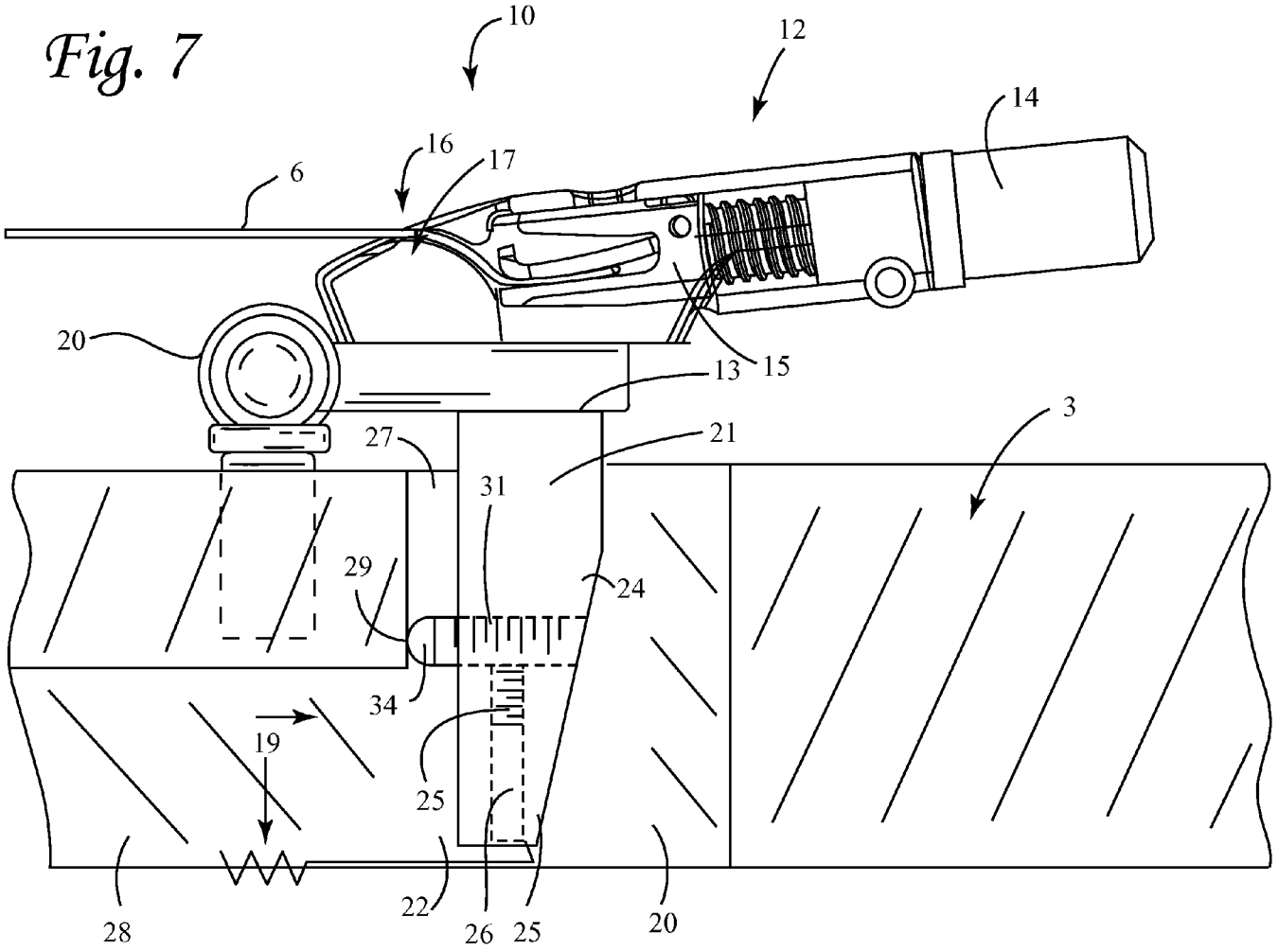
Figure 8:
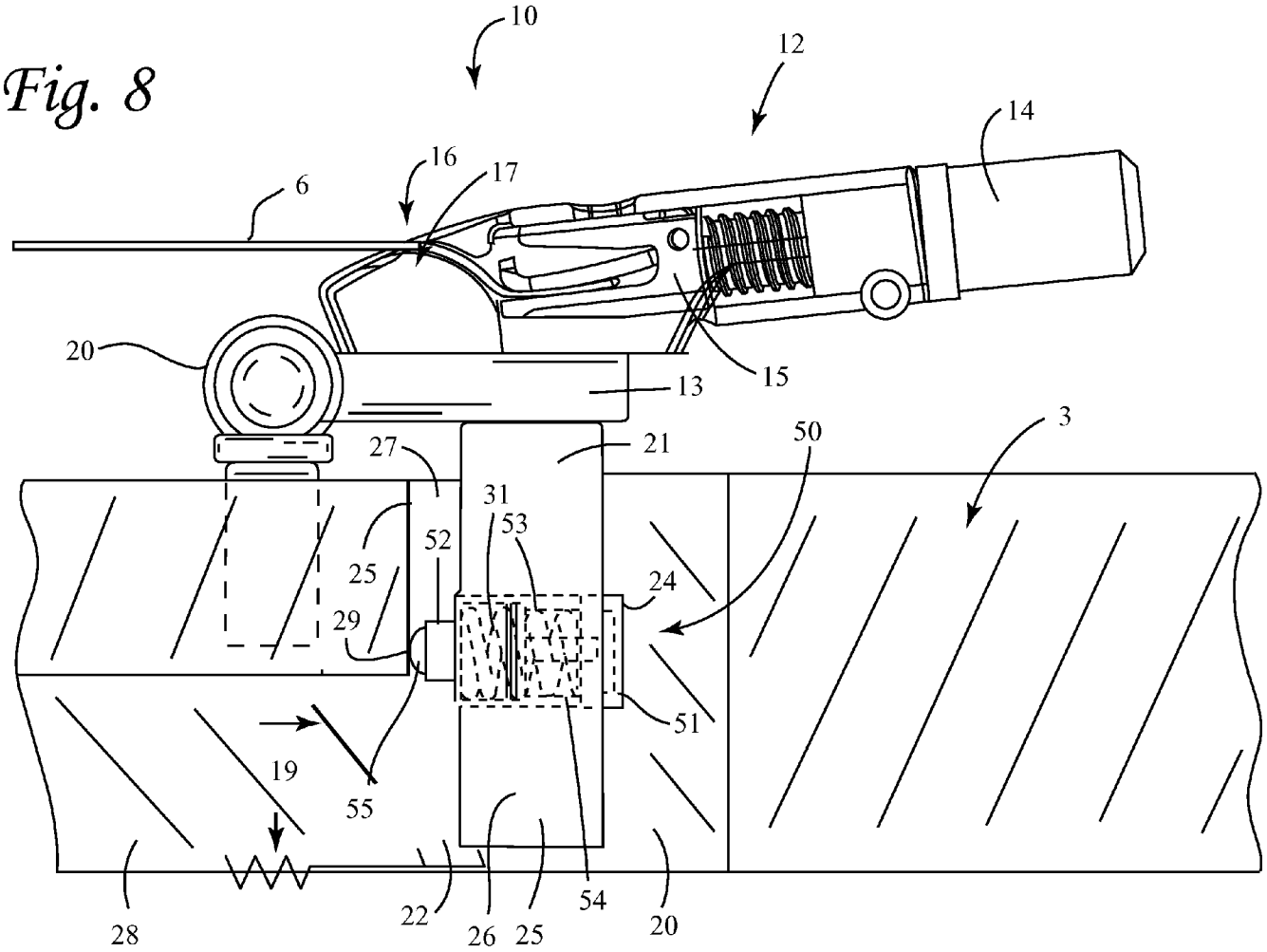

FIGS. 7 and 8 show two primary fundamental embodiments each notable for not employing an extended portion or thumbwheel.

FIG. 7 comprises another profile view showing the traditional spring block further comprising, and thereby moveable therewith, an adjustment element and set screw arrangement each threadedly engaged with the spring block. The adjustment element is threaded within the spring block to make initial contact with the instrument body to "stop" a tremolo; the setscrew secures the position and improves coupling between the three parts.

DETAILED DESCRIPTION OF THE INVENTION

Figure 1:
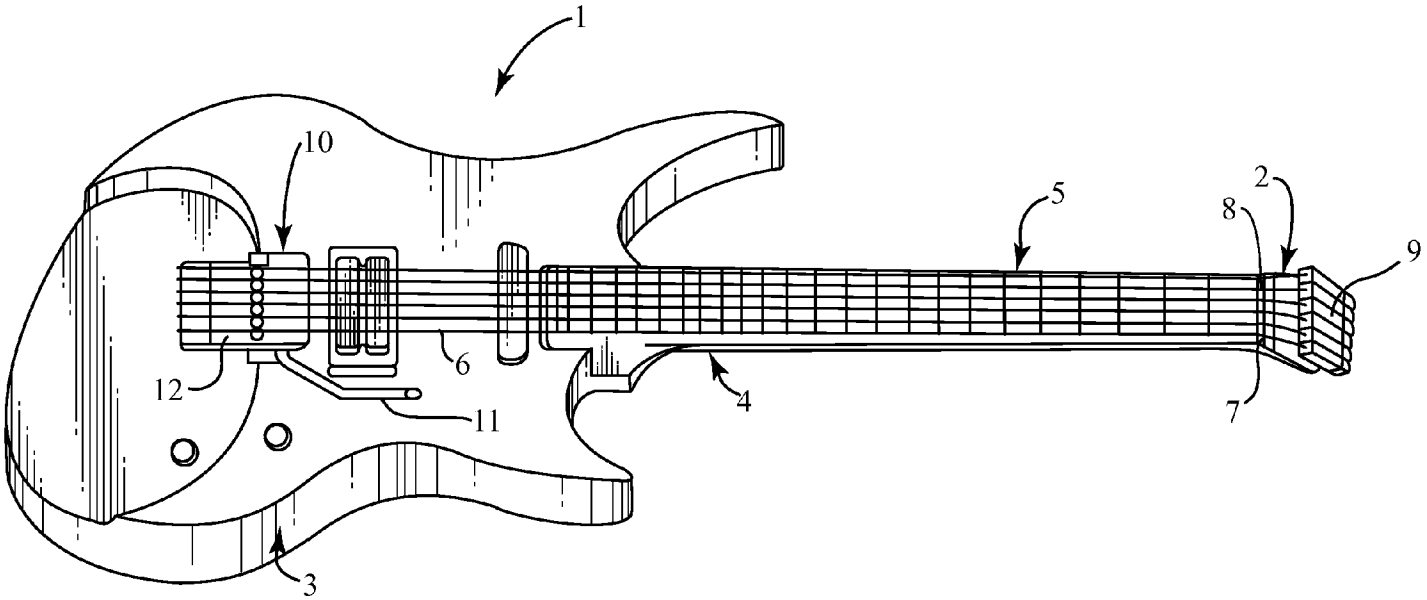
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extends from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted to achieve the desired tremolo effect.

Intonation module 12, shown as a macro-tuner, incorporating the function of bridge or saddle and tailpiece elements, is provided to support string 6. Intonation module 12 is slideably adjustable on base plate 13 to adjust the relative distance between first critical point 8 and second critical point 16 (FIG. 2) to adjust the harmonic tuning as such. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

FIG. 2 displays fulcrum tremolo 10 in a partial cross-section side view showing body 3 further comprising tremolo pocket 28 and tremolo spring pocket 29, tremolo stop mechanism 20 and locking macro-tuner 12. Second critical point 16 is located on intonation module 12 at string opening 17. The leading-edge portion of base plate 13 (not shown) adjustably supports base plate 14 pivotally relative to body 3.

First preferred embodiment for Stop Tuner 20 for fulcrum tremolo 10 comprising five parts: base element 21 connected to the base plate 13, holder element 22 including extended portion 23, thumbwheel 24, setscrew 25 and washer 26. Thumbwheel 24 further comprises smooth shaft 30 to rotatably engage base element through bore 32 and threaded shaft 31 to threadably engage holder element 22. Set screw 25 is tightened to fix the position of the extended portion 23 against tremolo pocket contact area 29 to limit the pivoting or rotation of the tremolo in one direction when at rest in initial position, ie., to "stop" fulcrum tremolo 10 and to improve acoustic coupling.

FIG. 3 illustrates an exploded view including main block 21 connected to base element 21, holder element 22 with extended portion 23 and thumbwheel element 24. Biasing element 19 is shown connected to holder element 22. Thumbwheel element 24 threaded portion 31 and smooth portion 30 passes through transverse opening 32 to engage threaded opening 33 in holder element 22 to position extended portion 23. Pre-tensioned compression spring-like element 35 secured to extended portion 23, compressed between extended portion 23 and tremolo pocket contact area 29 (not shown) at initial position, to provide a discontinuous force curve to biasing element 19 for a "soft" stop or Tremolo Stabilizer. Setscrew 25 is tightened to fix the position of extended portion 23 away from initial contact to allow free pivoting of tremolo 10 and to improve coupling amongst associated elements.

FIG. 4 shows alternate improved Tremolo Stabilizer 50, adapted to extended portion 23 of spring holder 22, further comprising tensioner element 51, guide element 52, fine adjustment element 55, pre-tensioned compression spring 53 and washer 54, adjustably positioned within extended portion 23 cooperating cavity 56 and cooperating spring block 21 cavity 57, operable with sufficient force to stabilize tremolo 10 to ensure initial position. Each stabilizer mechanism 50 with its limited capacity to urge spring block 21 in a direction away from nut 7 to collectively maintain, with its combined forces exerted against tremolo pocket contact area 29, tremolo 10 at initial position. Pre-tensioned compression spring 53 complements biasing element 19 to comprise a limited discontinuous force operable to increase the force required to pivot fulcrum tremolo 10 from initial position.

FIGS. 6 and 7 partial cross-section side views that show two alternative embodiments wherein each stabilizer mechanism 50 to maintain, with its related force exerted against tremolo pocket contact area 29, tremolo 10 at initial position.

The components in FIG. 6 shows a profile view of tremolo stabilizer mechanism 50 in its relative position to tremolo pocket contact area 29 shown in FIG. 4. The twin adjustable stabilizer mechanisms 50 (one only is shown in profile), capable of exerting a combined force of at least 8 to 10 pounds, whereby, positioned to make initial contact at tremolo pocket contact area 29, variably ensure initial position. Each stabilizer mechanism 50 comprises tensioner 51 threadedly engaged with extended portion 23 formed to receive washer 54 and pre-tensioned compression spring 53 operable to exert force on fine adjuster 55, theadedly supported by guide element 52, to make variable contact with tremolo pocket contact area 29 of body 3. Threading tensioner 51 is operable to vary pre-tension at initial contact and threading fine adjuster 55 within guide element 52 is operable to variably adjust initial contact at initial position to stabilize tremolo 10. Pre-tensioned compression spring 53 complements biasing element 19 to comprise a limited discontinuous force operable to increase the force required to pivot fulcrum tremolo 10 from initial position.

The components in FIG. 6 shows a further alternative example of Tremolo Stabilizer 50 comprising L-shaped bent piece of sheet metal 60 positioned on tremolo 10 with short leg 61 between spring block element 21 and base plate 13 and longer leg 62 extending with a mild curve comprising tip 63 contacting tremolo pocket contact area 29.

FIGS. 7 and 8 show in profile views of primary embodiments for each improvement without the benefit of extended portion 23 or thumbwheel 24.

The components in FIG. 7 showing simple stop arrangement comprising traditional spring block 21 further comprising, and moveable therewith, adjustment element 31 and set screw 25, adjustment element 34 and set screw 25 threadedly engaged with spring block 21. Adjustment element 34 comprising threaded portion 31 as shown to make initial contact with tremolo pocket contact area 29 at initial position to "stop" tremolo 10; setscrew 25 secures the position of adjustment element 34 and improves coupling between the three parts.

FIG. 8 shows tremolo 10 with single adjustable Tremolo Stabilizer 50 added to spring block 21. Stabilizer mechanism 50 comprises tensioner 51 threadedly engaged with extended portion 23 formed to receive washer 54 and pre-tensioned compression spring 54 operable to exert force on fine adjuster 55, theadedly supported by guide element 52, to make variable contact with tremolo pocket contact area 29 of body 3. Threading tensioner 51 is operable to vary pre-tension at initial contact and threading fine adjuster 55 within guide element 52 is operable to variably adjust to tremolo pocket contact area 29 at initial position to stabilize tremolo 10. Single pre-tensioned compression spring 54 comprises at least 8~10 pounds force. Any tendency for sharpened pitches, by pivoting tremolo 10 lightly and/or bending string 6, etc. activates stabilizer mechanism 50 with its limited capacity to urge spring block 21 in a direction away from nut 7 to collectively maintain, with its combined forces exerted against tremolo pocket contact area 29, tremolo 10 at initial position. Pre-tensioned compression spring 53 complements biasing element 19 to comprise a limited discontinuous force operable to increase the force required to pivot fulcrum tremolo 10 from initial position.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. An apparatus for a stringed musical instrument, the stringed musical instrument comprising a body, the body further comprising a top surface and a back surface, the top surface generally parallel to the back surface, the top surface and the back surfaces extending in the direction of the strings, a neck extending outwardly from the body, a plurality of strings extending in a direction from the body to the neck, a nut to form a first critical point for each of the strings, a bridge element forming a second critical point for supporting each of the plurality of strings on the body and a tailpiece for securing a plurality of strings to the body, a fulcrum tremolo pivotally mounted on the body for pivotally supporting the plurality of strings, a pivot axis for the fulcrum tremolo, the body further comprising a cavity formed to receive a fulcrum tremolo, the cavity further comprising a tremolo pocket, the tremolo pocket extending from the top surface to the back surface, the tremolo pocket comprising a first face and a second face, the first face closer to the nut, the first face generally perpendicular to the top surface of the body, the tremolo pocket to allow the spring block to pivot freely, the cavity further comprising a tremolo spring pocket, the spring pocket formed in the back of the body to receive the biasing element, the fulcrum tremolo operable to be pivoted rearward to increase tension and pitch of each of the plurality of strings, and forward to decrease tension and pitch of each of the plurality of strings, the fulcrum tremolo further comprising an apparatus, the apparatus secured to the fulcrum tremolo and moveable therewith around the pivot axis, the fulcrum tremolo operable to pivot freely within the body cavity, the fulcrum tremolo comprising:

a base plate comprising:
- a first side furthest the body,
- a second side closer the body, a biasing element, the biasing element comprising a first end and a second end, the first end connected to the fulcrum tremolo and the second end connected to the body, a spring block, the spring block secured to, and moveable therewith, the fulcrum tremolo base plate, the spring block operable to receive the biasing element, the apparatus comprising:

the spring block further having a first opening, the spring block further comprising:

a base element, the base element transverse the direction of the strings, generally perpendicular to the base plate second side, the base element comprising:
- a connecting end, the connecting end closest the base plate,
- a supporting end, the support end furthest the base plate, a holder element, the holder element comprising a threaded opening, the threaded opening aligned to the first opening, the holder element transverse the direction of the strings, the holder element variably connected to the supporting end and the biasing element, the holder element further comprising:
- a biasing end, the biasing end further the base plate, the biasing end formed to receive the first end of the biasing element,
- an extended portion, the extended portion transverse the direction of the strings extending from the biasing end in the direction of the second side, a thumbwheel element, the thumbwheel element further comprising a threaded portion, the thumbwheel element rotatably connected to the base element and threadedly connected to the holder element, the thumbwheel element operable to variably position the extended portion, a setscrew element, the setscrew element threadedly connected to the base element, the setscrew element in variable contact with the thumbwheel element, threading the setscrew element in a first direction operable to fix the position of adjustment element, threading the setscrew element in a second direction to disengage with the thumbwheel element, wherein the fulcrum tremolo at initial position, the apparatus operable either:

1) to thread the thumbwheel element to position the extended portion to make initial contact with the body to impede the pivoting of the fulcrum tremolo in one direction, and to thread the setscrew element in a first direction to fix the position of the extended portion to stop the fulcrum tremolo, or, 2) to thread the thumbwheel element to adjustably position the holder element to disengage the extended portion sufficiently from the body for global tuning, and to thread the setscrew element in a first direction to fix the spring holder position at initial position.

2. Apparatus of claim 1 wherein the spring block further comprising:

a tremolo stabilizer assembly, the tremolo stabilizer assembly further comprises a pre-tensioned compression spring element, the pre-tensioned compression spring element secured to the extended portion, the pre-tensioned compression spring element operable to make initial contact with the first face, the first face further comprising a tremolo pocket contact area, the tremolo pocket contact area operable to receive variable contact from the pre-tensioned compression spring element, wherein the fulcrum tremolo at initial position, the pre-tensioned compression spring element positioned to make initial contact with the tremolo pocket contact area to complement the biasing element to comprise a discontinuous force operable to increase the force required to pivot the fulcrum tremolo from initial position.

3. Apparatus of claim 1 wherein:

the first face further comprising a tremolo pocket contact area, the tremolo pocket contact area operable to receive variable contact from the pre-tensioned compression spring element, the holder element further comprises a tremolo stabilizer assembly, the holder element formed to threadedly receive the tremolo stabilizer assembly, the tremolo stabilizer assembly operable to make initial contact with the first face, the tremolo stabilizer assembly further comprises:

a spring tensioner element, the spring tensioner element formed to adjustably receive the pre-tensioned compression spring element, the spring tensioner element theadedly connected to the holder element operable to tension and adjust the force of the pre-tensioned compression spring element, the spring tensioner element further formed to adjustably receive:

a guide element, the guide element operable to variably support the pre-tensioned compression spring element, an adjustable contact pin element, the adjustable contact pin element threadely connected to the guide element, the adjustable contact pin element further comprising a tip, threading the adjustable contact pin element operable to position the tip relative to the spring block, wherein the adjustable contact pin element operable to make initial contact with the tremolo pocket contact area at initial position to complement the biasing element to comprise a discontinuous force operable to increase the force required to pivot the fulcrum tremolo from initial position.

4. The apparatus of claim 1 wherein the extended portion operable to make initial contact with tremolo pocket contact area to limit pivoting in one direction.

5. Apparatus of claim 1 further comprises a pre-determined compression spring element, the pre-tensioned compression spring element positioned to make initial contact against the tremolo pocket contact area to complement the biasing element to comprise a discontinuous force operable to increase the force required to pivot the fulcrum tremolo from initial position, wherein a thumbwheel element, the thumbwheel comprising an elongated threaded portion, the threaded portion connected to the holder element threaded opening, the thumbwheel element operable to variably thread the holder element relative to the spring block to adjust the force of biasing element.

* * * * *